US006427396B1

(12) United States Patent
Harrison

(10) Patent No.: US 6,427,396 B1
(45) Date of Patent: Aug. 6, 2002

(54) BARRIER ARRANGEMENT

(75) Inventor: John Ian Rhys Harrison, Narberth (GB)

(73) Assignee: Floodgate Limited, Cardiff (GB)

( * ) Notice: Subject to any disclaimer, the term of this patent is extended or adjusted under 35 U.S.C. 154(b) by 0 days.

(21) Appl. No.: 09/777,118

(22) Filed: Feb. 5, 2001

(51) Int. Cl.[7] ..... E06B 3/26

(52) U.S. Cl. ..... 52/202; 52/645; 52/656.7; 49/55; 49/61

(58) Field of Search ..... 52/213, 215, 217, 52/202, 208, 645, 656.7; 49/55, 61, 62, 463, 465, 466, 57; 405/87, 107, 115; 160/216, 374, 375

(56) References Cited

U.S. PATENT DOCUMENTS

| | | | | |
|---|---|---|---|---|
| 2,169,985 | A | * | 8/1939 | Hiza |
| 2,848,762 | A | * | 8/1958 | Peterson |
| 4,837,974 | A | * | 6/1989 | Jokel |
| 5,531,258 | A | * | 7/1996 | Poulson |
| 5,595,233 | A | * | 1/1997 | Gower |
| 5,638,885 | A | * | 6/1997 | Freese |
| 5,937,595 | A | * | 8/1999 | Miller |
| 5,937,596 | A | * | 8/1999 | Leeuwenburgh |
| 5,943,832 | A | * | 8/1999 | Russell |
| 6,216,402 | B1 | * | 4/2001 | Van de Laar |
| 6,276,741 | B1 | * | 8/2001 | Campfield |
| 6,289,642 | B1 | * | 9/2001 | Diamond |
| 6,308,474 | B1 | * | 10/2001 | Wilson |
| 6,325,085 | B1 | * | 12/2001 | Gower |

FOREIGN PATENT DOCUMENTS

| | | |
|---|---|---|
| DE | 4023286 A1 | 1/1982 |
| EP | 0841458 A2 | 7/1997 |
| GB | 2114197 A | 7/1982 |
| WO | WO91/16519 | 10/1991 |
| WO | WO94/27480 | 12/1994 |
| WO | WO97/13052 | 4/1997 |

* cited by examiner

*Primary Examiner*—Carl D. Friedman
*Assistant Examiner*—Kevin McDermott
(74) *Attorney, Agent, or Firm*—David P. Gordon; David S. Jacobson; Thomas A. Gallagher

(57) ABSTRACT

A frame expandable in a structural opening has a stretchable substantially fluid impermeable cover membrane disposed across the frame and arranged to stretch with expansion of the frame. The frame is preferably expandable in mutually perpendicular directions, and provided with peripheral seals for sealing in the structural arrangement. The barrier is conveniently fitted in openings such as doors and the like to provide a temporary barrier to rising floodwaters and the like.

17 Claims, 2 Drawing Sheets

BARRIER ARRANGEMENT

BACKGROUND OF THE INVENTION

1. Field of the Invention

The present invention relates to a barrier arrangement and more particularly to a barrier arranged to inhibit fluid passing through a structural opening.

2. State of the Art

Barriers for preventing fluid egress through building structures are well-known for example for inhibiting water flooding of buildings through window or door openings.

An improved barrier arrangement has now been devised.

SUMMARY OF THE INVENTION

According to the invention, there is provided a barrier arrangement for a structural opening, the barrier arrangement comprising:

i) a frame expandable in the opening; and, ii) a stretchable substantially fluid impermeable cover membrane disposed across the frame and arranged to stretch with expansion of the frame.

Desirably the frame is expandable in a plurality of directions, preferably mutually transverse (most preferably mutually perpendicular) directions.

The frame preferably comprises spaced side frame elements and spaced top and bottom frame elements. Advantageously, at least some of the frame elements are linked telescopically (one element nested within another) to enhance the expandabilty of the frame. The frame preferably comprises a frame including rigid frame elements, desirably comprising rigid material such as metallic material or rigid plastics material.

The frame is preferably collapsible from its expanded position to a collapsed position for removal from the structural opening and/or storage.

Beneficially, peripheral portions of the barrier are provided with seal means arranged to seal against the structural opening. The seal means is preferably arranged to be compressible, preferably being caused to compress upon expansion of the frame in the opening.

Seal means are preferably provided on opposed side portions of the frame and also preferably along the lowermost portion of the frame. The seal means may be provided integrally with the cover membrane, at peripheral portions thereof.

The barrier arrangement preferably includes expansion means facilitating expansion of the frame in the opening. The expansion means may comprise rotational means (such as a screw threaded drive) arranged to drive a linear expansion of the frame.

The expansion means may comprise a fluid power arrangement (such as pneumatic or hydraulic actuator means).

Alternatively the expansion means may comprise a mechanical or electromechanical actuation arrangement. For example an expandable mechanical linkage (such as a scissors type linkage) may be utilised. The expansion means may be manually or electrically driven. Desirably force limitation means is utilised to prevent over forcing the frame into expanding engagement with the structural opening.

Where the frame is expandable in mutually perpendicular directions different expansion means may be provided facilitating expansion in perpendicular directions.

Desirably, the expansion means comprises means for expanding the frame such that peripheral frame elements separate moving in opposed directions simultaneously so as to engage mutually opposed portions of the structural opening. Desirably, the expansion means comprises means for expanding the frame in a direction transverse (preferably perpendicular) to the direction of separation of the separating peripheral frame elements. Beneficially, the barrier means comprises first frame portions expandable to separate from one another to engage opposed portions of the structural opening the first frame portions carrying respective second frame portions moveable (preferably independently of one another) in a direction perpendicular to the separation direction of the first frame portions.

The expansion means may be permanently carried by the frame. Alternatively the expansion means may be demountable from the frame.

It is preferred that the cover membrane is expandable in mutually perpendicular directions, advantageously comprising a sheet of fluid impermeable material. Desirably, the material of the cover membrane is resilient so as to return to a more relaxed position when the frame is collapsed from its expanded position. The cover membrane beneficially comprises a peripheral portion (or portions) arranged to grip the frame. The cover portion may, for example comprise a partial envelope having a peripheral portion (or portions) folded about the periphery of the frame. The cover membrane preferably comprises an elastomeric material (such as a rubber material) or plastics material.

It is particularly preferred that the peripheral portion or portions of the cover membrane folded about the periphery of the frame has, on the face of the frame that will engage with the portion of the structure defining the structural opening, a surface profile adapted to resiliently deform to compensate for any roughness of the surface of the structure. Most preferably, the profile is, in section an "m" shape. The profile is adapted to provide a seal about the edge of the barrier arrangement.

The invention will now be further described in a specific embodiment by way of example only and with reference to the accompanying drawings.

DETAILED DESCRIPTION OF THE PREFERRED EMBODIMENTS

Figure 1:
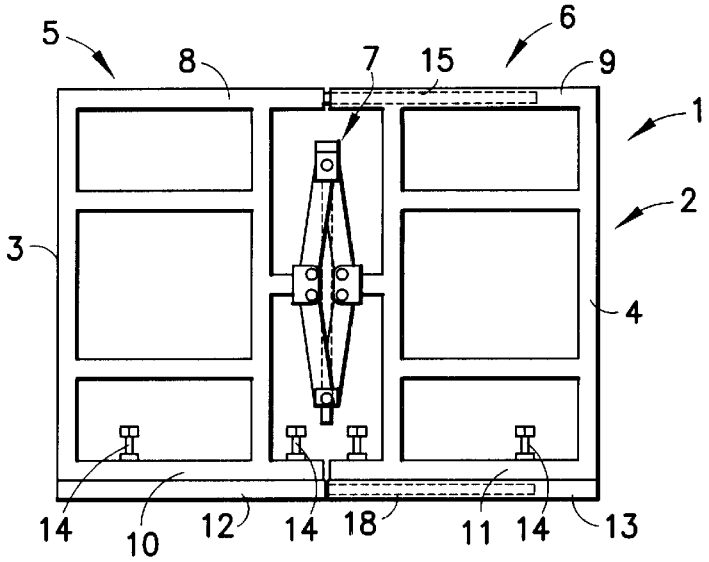
FIG. 1 is a schematic side view of a barrier arrangement according to the invention in a collapsed configuration.
Figure 2:
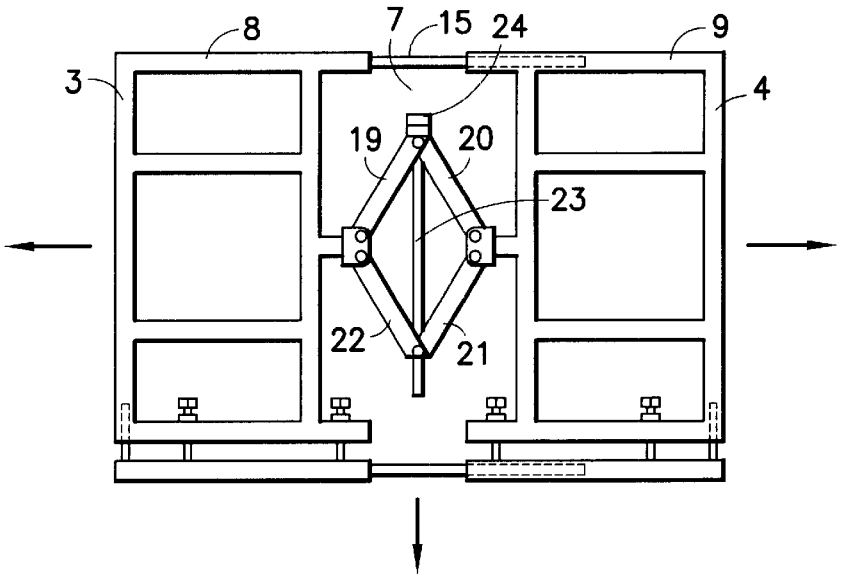
FIG. 2 is a side view of the barrier arrangement of FIG. 1 in an expanded configuration.
Figure 3:
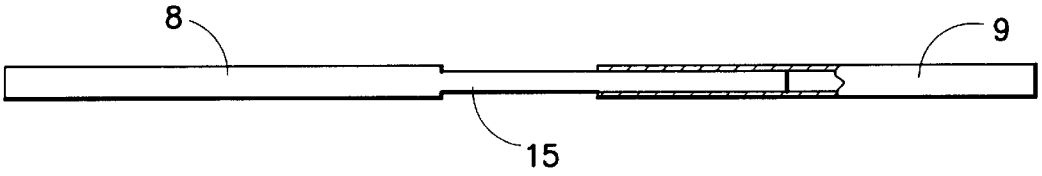
FIG. 3 is a plan view of the barrier arrangement in a condition shown in FIG. 2.
Figure 4:
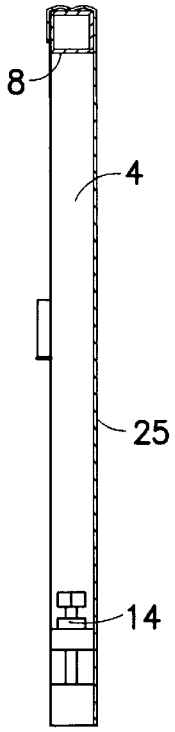
FIG. 4 is an end view of the barrier arrangement of FIGS. 1 to 3.
Figure 5:
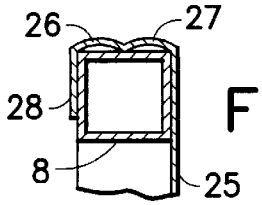
FIG. 5 is an enlarged broken section view of an upper portion of the arrangement of FIG. 4.

Referring to the drawings, the barrier arrangement (generally designated 1) comprises a metallic box section frame 2 comprising two frame halves 5,6 which are moveable away from, or toward, one another in accordance with operation of an actuation mechanism 7. Each frame half 5,6 comprises a respective side frame element 3,4 connected to respective uppermost frame element 8,9 and lower frame element 10,11. Each lower frame element 10,11 carries a bottom rung 12,13 which is secured to the underside of the respective lower frame element 10,11 but moveable away from or towards the respective frame element 10,11 by means of operation of bolts 14 threadably received in respective threaded nuts secured to frame element 10,11. Upper frame element and lower rung 12 each carry a respective projecting limb 15,18 which is telescopically received within the interior of the adjacent respective upper element 9 and lower rung 13. Limbs 15,18 are friction fitting within the hollow channel section of upper element 9 and lower rung 13 respectively in order to enhance the rigidity of the frame is maintained when in the expanded configuration.

The actuation mechanism 7 is operable from the rear side of the apparatus and comprises a pivotal linkage mechanism including pivoting arms 19,20,21,22 and a threaded actuation rod 23 which is actuatable by a nut 24 provided at an end thereof.

Turning nut 24 causes the threaded rod 23 to rotate about its axis and the lowermost ends of arms 22,21 to be drawn toward the nut 24 in order to expand the frame 1. Conversely, in order to retract the frame to a collapsed configuration, the nut 24 is rotated in the opposite sense causing the lowermost ends of arms 21,22 to move away from nut 24 due to the threaded connection with threaded rod 23.

The obverse face of the frame is covered by a flexible (expandable) rubber sheet 25 envelope which is stretched across the frame and provided in the form of a partial envelope having peripheral edges 26 which overlap the frame, thereby securing the sheeting in position. In FIGS. 1,2,6 and 7 the planar portion of the sheet extending across the frame is not shown, for the purpose of clarity of explanation of the operation of the barrier frame. The outermost edges 27 of the rubber sheet envelope 25 are preformed to have a portion which abuts the frame members 8,9,3,4,11,12, and portions which stand proud of the respective frame element. By this means, edge portions 27 of the rubber sheet envelope are arranged to collapse/flatten against the respective frame element when the frame is expanded into abutment with the walls of the structural opening across which the barrier is positioned. This provides an efficient seal with the relevant wall. The rubber sheet 25 enveloping the frame terminates in a free edge portion 28 which extends around the frame permitting access to the rear of the frame (and for example the actuating mechanism 7).

In use, the arrangement including the rubber sheet 25 in position stretched across the frame 1 is positioned in its collapsed configuration in position in the structural opening to be barred. The actuation mechanism 7 is then operated to cause the frame 1 to expand such that frame portions 2, 3 move away from one another until the side frame elements (covered by the peripheral sealed portion 27 of sheet 25) engage respective side walls of the structural opening. The nut 24 may, for example, be actuated by a preset torque wrench such that the frame is not over tightened in the opening. When in position with the barrier engaging the side walls of the structural opening, bolts 14 are operated to force rungs 12, 13 downwardly into engagement with the base portion of the structural opening in order to achieve an efficient seal therewith. When expanding the frame by operation of actuation mechanism 7 and bolts 14, the rubber sheet 25 stretches with the frame.

Figure 6:
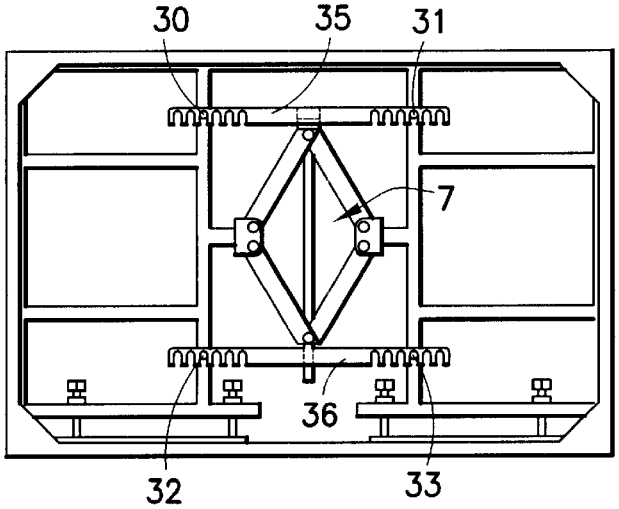
FIG. 6 is a schematic side view of an alternative embodiment of the barrier arrangement according to the invention.

As shown in FIG. 6, respective frame portions 2,3 may carry respective projections 30,31,32,33 arranged to co-operate with spaced recesses on bracing struts 35,36 which serve to aid rigidity of the barrier in its expanded configuration. In certain embodiments the actuation mechanism 7 may be demountable from the frame, such that a plurality of separate barriers may be installed using the same actuating mechanism. This is particularly useful for the emergency services, for example, for installing a large number of barriers in close proximity at minimum expense. In such circumstances, bracing struts 35,36 act as primary bracing elements.

The barrier arrangement of the invention provides a number of advantages. For example the arrangement is easily assembled on site and may be assembled whilst flooding is occurring.

Additional barriers may be positioned in side by side relationship either horizontally or vertically and expanded in order to increase the area covered by the barrier.

Figure 7:
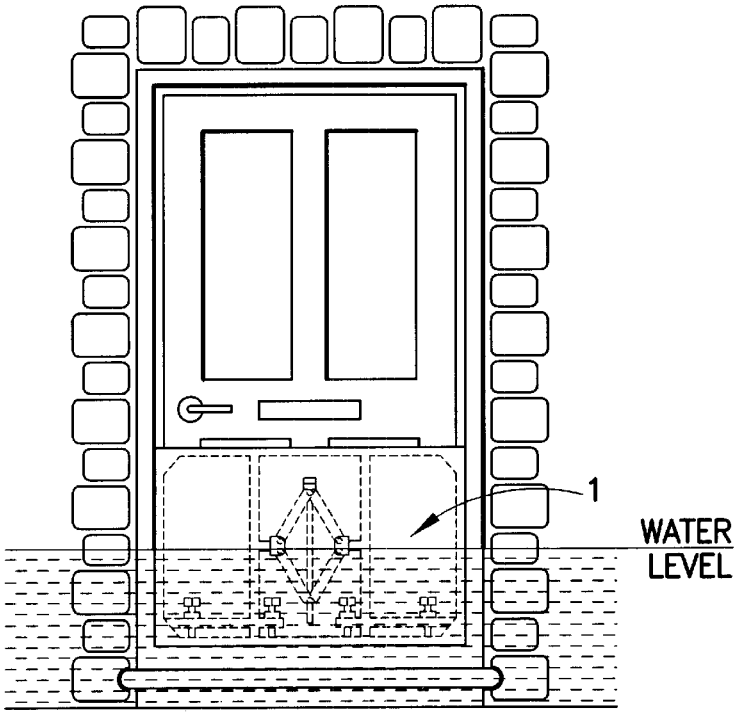
FIG. 7 is a schematic view showing a barrier arrangement according to the invention in use.

As shown in FIG. 7, the barrier arrangement is particularly useful for restricting flood damage through structural openings such as doors, windows and the like.

What is claimed is:

1. A barrier arrangement for a structural opening, said barrier arrangement comprising:

i) a frame reversibly expandable in said opening; and ii) a stretchable substantially fluid impermeable cover membrane disposed across said frame and arranged to stretch with expansion of said frame;

wherein the frame and cover membrane are each expandable in a plurality of directions.

2. A barrier arrangement according to claim 1, wherein said frame and cover membrane are both expandable in mutually perpendicular directions.

3. A barrier arrangement according to claim 1, wherein said frame comprises spaced side frame elements and spaced top and bottom frame elements.

4. A barrier arrangement according to claim 2, wherein said frame comprises spaced side frame elements and spaced top and bottom frame elements.

5. A barrier arrangement according to claim 3, wherein a plurality of said frame elements are linked telescopically.

6. A barrier arrangement according to claim 4, wherein a plurality of said frame elements are linked telescopically.

7. A barrier arrangement according to claim 1, wherein at least three peripheral edges of the barrier arrangement are provided with seal means arranged to seal against said structural opening.

8. A barrier arrangement according to claim 7, wherein said seal means is provided integrally with said cover membrane.

9. A barrier arrangement according to claim 7 in which said seal means has a substantially "m" shaped cross section.

10. A barrier arrangement according to claim 8 in which said seal means has a substantially "m" shaped cross section.

11. A barrier arrangement according to claim 1, further comprising at least one expansion means so as to facilitate expansion of said frame in said opening.

12. A barrier arrangement according to claim 11, wherein said at least one expansion means comprises one of a rotational means, a fluid power arrangement, a mechanical, or an electro mechanical actuation arrangement arranged to drive a linear expansion of said frame.

13. A barrier arrangement according to claim 11, wherein the expansion means comprises:

a) means for expanding said frame such that peripheral edges of the barrier arrangement separately move in opposed directions substantially simultaneously so as to engage mutually opposed portions of said structural opening; or b) means for expanding said frame in a direction perpendicular to a direction of separation of said peripheral edges.

14. A barrier arrangement according to claim 12, wherein the expansion means comprises:

means for expanding said frame such that peripheral edges of the barrier arrangement separately move in opposed directions substantially simultaneously so as to engage mutually opposed portions of said structural opening; or b) means for expanding said frame in a direction perpendicular to a direction of separation of said peripheral edges.

15. A barrier arrangement according to claim 1, wherein said cover membrane comprises at least one peripheral portion arranged to grip said frame.

16. A barrier arrangement according to claim 3, wherein said frame elements are rigid.

17. A barrier arrangement according to claim 4, wherein said frame elements are rigid.

* * * * *